US009687125B2

(12) United States Patent
Marietta-Tondin et al.

(10) Patent No.: US 9,687,125 B2
(45) Date of Patent: Jun. 27, 2017

(54) SHEET PRODUCT DISPENSER

(71) Applicant: SCA TISSUE FRANCE, Saint-Ouen (FR)

(72) Inventors: Julien Marietta-Tondin, Marckholsheim (FR); Gilles Cattacin, Colmar (FR); Yves Stoeffler, Sarreguemines (FR)

(73) Assignee: SCA TISSUE FRANCE, Saint-Ouen (FR)

( * ) Notice: Subject to any disclaimer, the term of this patent is extended or adjusted under 35 U.S.C. 154(b) by 332 days.

(21) Appl. No.: 14/366,419

(22) PCT Filed: Dec. 18, 2012

(86) PCT No.: PCT/IB2012/002747
§ 371 (c)(1),
(2) Date: Jun. 18, 2014

(87) PCT Pub. No.: WO2013/093596
PCT Pub. Date: Jun. 27, 2013

(65) Prior Publication Data

US 2015/0122937 A1 May 7, 2015

(30) Foreign Application Priority Data

Dec. 20, 2011 (EP) ..... 11010001

(51) Int. Cl.
*A47K 10/38* (2006.01)
*A47K 10/32* (2006.01)

(52) U.S. Cl.
CPC .. *A47K 10/3818* (2013.01); *A47K 2010/3206* (2013.01)

(58) Field of Classification Search
CPC ..... A47K 10/3818; A47K 2010/3206
(Continued)

(56) References Cited

U.S. PATENT DOCUMENTS 5,141,171 A 8/1992 Yang
5,215,211 A 6/1993 Eberle
(Continued)

FOREIGN PATENT DOCUMENTS

RU 2011896 C1 4/1994
SU 153430 A1 12/1963
(Continued)

OTHER PUBLICATIONS

Russian Office Action dated Dec. 1, 2016 issued in corresponding Russian patent application No. 2014129533 (1 page) and its English-language translation thereof (5 pages).
(Continued)

*Primary Examiner* — William A Rivera
(74) *Attorney, Agent, or Firm* — Drinker Biddle & Reath LLP

(57) ABSTRACT

A sheet product dispenser includes a housing for accommodating a source of a sheet product and a dispenser opening for dispensing the sheet product. The dispenser opening is provided in a rotatable dispensing member. Rotation of the rotatable dispensing member is restricted to one rotating axis. The dispenser opening is offset from the rotating axis of the rotatable member. Rotation of the rotatable dispensing member results from a lateral force applied by a pulled sheet product strip onto the dispenser opening such that the dispenser opening moves as far as possible into a pulling direction so as to minimize an angle between the pulling direction and a dispensing direction of the dispenser opening.

18 Claims, 6 Drawing Sheets

(58) Field of Classification Search
USPC ..... 242/593
See application file for complete search history.

(56) References Cited

U.S. PATENT DOCUMENTS

| | | | | | |
|---|---|---|---|---|---|
| 5,246,137 | A * | 9/1993 | Schutz | A47K 10/3818 | 206/409 |
| 5,263,607 | A * | 11/1993 | Temesvary | A47K 10/3818 | 221/304 |
| 5,273,184 | A * | 12/1993 | Rizzuto | A47K 10/3818 | 221/286 |
| 5,370,338 | A | 12/1994 | Lewis | | |
| 5,577,634 | A * | 11/1996 | Morand | A47K 10/3818 | 221/33 |
| 5,762,286 | A | 6/1998 | Schutz | | |
| 5,857,642 | A * | 1/1999 | Zinnbauer | A47K 10/3818 | 221/303 |
| 7,025,301 | B1 * | 4/2006 | Notarnicola | A47K 10/3818 | 242/593 |
| 7,275,672 | B2 * | 10/2007 | Haen | A47K 10/3818 | 221/220 |
| 7,287,720 | B1 * | 10/2007 | Allegre | A47K 10/38 | 206/409 |
| 2002/0056718 | A1 * | 5/2002 | Paukov | A47K 10/3818 | 221/63 |
| 2008/0290210 | A1 | 11/2008 | Tramontina et al. | | |
| 2009/0120951 | A1 | 5/2009 | Titas et al. | | |

FOREIGN PATENT DOCUMENTS

| | | | |
|---|---|---|---|
| WO | WO-98/25848 | A1 | 6/1998 |
| WO | WO 2007/027352 | A1 | 3/2007 |

OTHER PUBLICATIONS

Mexican Office Action No. 5351 dated Jan. 23, 2017 issued in counterpart Mexican patent application No. Mx/a/2014/007418 (3 pages) and its partial English-language translation thereof (4 pages).

* cited by examiner

SHEET PRODUCT DISPENSER

CROSS-REFERENCE TO PRIOR APPLICATION

This application is a §371 National Stage Application of PCT International Application No. PCT/IB2012/002747 filed Dec. 18, 2012, which claims priority to EP 11010001.3, filed Dec. 20, 2011, both of which are incorporated herein in their entirety.

TECHNICAL FIELD

The present disclosure generally relates to sheet product dispensers for dispensing a sheet product as a strip of a sheet product, such as sheet-shaped paper towels for use in bathrooms, public toilets and the like. In particular, the present disclosure relates to measures concerning the dispensing of a sheet product through a dispenser opening.

BACKGROUND

Manually operated sheet product dispensers are commonly used for dispensing sheet product strips like paper sheets such as paper towels, facial tissue, or the like. Such sheet product strips strongly differ in properties such as thickness and surface roughness so that sheet products differ strongly in their sliding properties and their tensile strength when used with a provided dispenser.

Dispensers usually comprise a housing in which a source of sheet product, e.g. a paper roll or a stack of a continuous paper strip, is accommodated. In cases where the source of sheet product is a continuous strip of paper sheets, the single sheets are attached to one another by a perforation line transverse to the strip direction in order to facilitate sheet tearing.

Manually operated dispensers are usually mounted on a wall. For dispensing the sheet product, these dispensers have a dispenser opening located in the bottom of the dispenser through which the sheet product strip is guided to the exterior of the housing.

A center feed toilet paper dispenser is known from WO 98/25848. This dispenser holds the toilet paper in a stationary position as the loose paper and is pulled from the inner core of the paper roll. A housing for containing the paper roll is attached to a base and a cover engaged with the housing compresses the paper roll against the base. This compression prevents sag of the layered toilet paper roll as the void in the paper core became enlarged.

There are various known types of dispenser openings which differ substantially in the frictional force applied to the sheet product during dispensing. One type of dispenser opening comprises a sharp edge that is used for detaching suitably sized perforated sheets. In this context, US 2008/0290210 A1 discloses a dispenser opening in which the sheet product passes through a Z-shaped path, which causes the sheet product to break as desired. The dispenser opening is attached such that it is free to pivot along two axes to avoid any extreme deflection of the sheet product strip at the opening edge.

Other approaches are directed to reducing frictional force on the sheet product. For example, U.S. Pat. No. 5,141,171 A discloses an opening with a mouthpiece which is mounted pivotally about one axis such that the dispensing direction of the opening can be partially adjusted to accommodate an inclined pulling direction of a consumer.

One issue that may arise for such a dispenser opening is that a frictional force applied to the sheet product strip during dispensing is inadequate which results in individual sheets becoming difficult to tear off. Another issue that may arise is that the frictional force becomes too great which results in the sheet product being separated into unsuitable small pieces upon pulling or the leading edge of the sheet product remaining within or even being pulled back into the dispenser housing, leaving it difficult to reach for the user.

The same is true for the design of the dispenser opening. A deflection at the opening edge that applies a tensile force above the breaking force of the strip could lead to a breaking of the sheet product strip at the corresponding perforation line right at the opening edge. This may result in difficulties for the next user of the dispenser to grab the strip's end to pull out the next sheet, especially if the opening is too small to grasp the strip's end lost therein.

SUMMARY

It is desired to provide a sheet product dispenser capable of suitably adjusting a frictional force applied to a sheet product during dispensing, in particular, avoiding increasing impact of different pulling directions of a user.

According to one aspect, there is provided a sheet product dispenser, including a housing to accommodate a source of a sheet product and a dispenser opening for dispensing the sheet product, wherein the dispenser opening is provided in a rotatable dispensing member, wherein rotation of the rotatable dispensing member is restricted to one rotating axis, and the dispenser opening is offset from the rotating axis of the rotatable member, and wherein rotation of the rotatable dispensing member results from a lateral force applied by a pulled sheet product strip onto the dispenser opening such that the dispenser opening moves as far as possible into a pulling direction so as to minimize an angle between the pulling direction and a dispensing direction of the dispenser opening.

Such a dispenser allows rotation of the dispenser opening upon pulling a leading end of sheet product in an inclined pulling direction such that a distance to the user as well as the angle between the pulling direction and the dispensing direction of the opening is reduced and a frictional force applied to the sheet product becomes smaller compared to a dispenser having an opening that is fixed in its position.

A cross section of the opening may be inclined from the rotating axis, thereby further reducing the above described angle for pulling directions. In particular, an axis perpendicular to the cross-section of the dispenser opening may be inclined toward a direction of the offset. In other words, a cross section of the dispenser opening perpendicular to the dispensing direction is inclined from the rotating axis.

Furthermore, a reset means may be provided to exert a reset force onto the rotatable dispensing member so that the rotatable dispensing member is rotatable towards a reset position if deflected.

The opening can be provided in a dispensing mouthpiece pivotally attached to the rotatable member, which allows the mouthpiece to pivot about at least one axis, in particular, about two axes perpendicular to each other, thereby providing additional degrees of freedom for adjustment to the pulling direction.

The dispensing mouthpiece may include a ball joint mounted in a partially spherical shaped socket in the rotatable member. Such an arrangement provides even more degrees of freedom for the dispenser opening to reduce deflection of the sheet product strip at an edge of the opening and thereby reducing friction.

A mechanical stop can be provided, adapted to limit the rotation of the rotatable member to less than 360°, in particular to less than 180°. Such a mechanical stop can prevent the sheet product from becoming twisted. In case the rotation is restricted to less than 180°, it should prevent the rotatable member from becoming stuck in a situation where the sheet product is pulled in a direction opposite the current dispensing direction of the opening.

The dispenser may further include a support means adapted to support the source of the sheet product within the housing, and to prevent displacement of the rotatable member in the housing. Integrating such functions into a single member can reduce costs of the dispenser.

The rotatable member can be mounted in a circular socket adapted to prevent displacement of the rotatable member to the exterior of the housing. This ensures that the rotatable member is rotated rather than tilted upon pulling a sheet product.

The dispensing mouthpiece can have a straight guideway for the sheet product along the dispensing direction of the opening, thereby reducing folding and wrinkling of the sheet product.

The dispenser may further include a rounded lip portion located at the rotatable member close to an inlet of the mouthpiece and adapted to support the sliding of the sheet product on a dispensing path during dispensing. Such a configuration provides further capability for adjusting frictional forces.

According to another embodiment, a support element may be provided with a support arm and a center portion, wherein the support arm extends downwardly from the housing toward the rotating axis, wherein the center portion provides a bearing to bear the rotating dispensing member.

Moreover, the center portion may protrude in the direction to the housing along the rotating axis, wherein the dispensing member has a center opening through which the center portion protrudes to provide the bearing.

Furthermore, a cap may be provided that is attached onto the center portion to hold the dispensing member in a form fit manner.

It may be provided that the dispensing member has a cut-out with a longitudinal shape in radial direction, wherein an adjustment element is arranged enclosing the cut-out, wherein the adjustment element includes an inner opening which can be moved relatively to the cut-out.

According to a further aspect, there is provided a sheet product dispensing system, including the sheet product dispenser as described above and a source of a sheet product, wherein the sheet product includes a sheet product strip the leading end of which is guided through the dispenser opening.

According to a further aspect, a dispensing element of a sheet product dispenser is provided, including:

a rotatable dispensing member that has a dispenser opening for dispensing the sheet product, a socket for rotatably mounting the rotatable dispensing member;

wherein the socket is adapted to restrict a rotation of the rotatable member to one rotating axis, and wherein the dispenser opening is offset from the rotating axis of the rotatable member.

BRIEF DESCRIPTION OF THE DRAWINGS

Other features and advantages will become apparent when reading the following non-limiting, detailed description for understanding of which reference will be made to the attached drawings in which.

DETAILED DESCRIPTION OF PREFERRED EMBODIMENTS

Reference will now be made in detail to the present exemplary embodiments of the invention, examples of which are illustrated in the accompanying drawings. Wherever possible, the same reference numbers will be used throughout the drawings and the following detailed description to refer to the same or like parts.

In the following, a manually operated dispenser will be described with reference to FIGS. 1 to 3.

Figure 1:
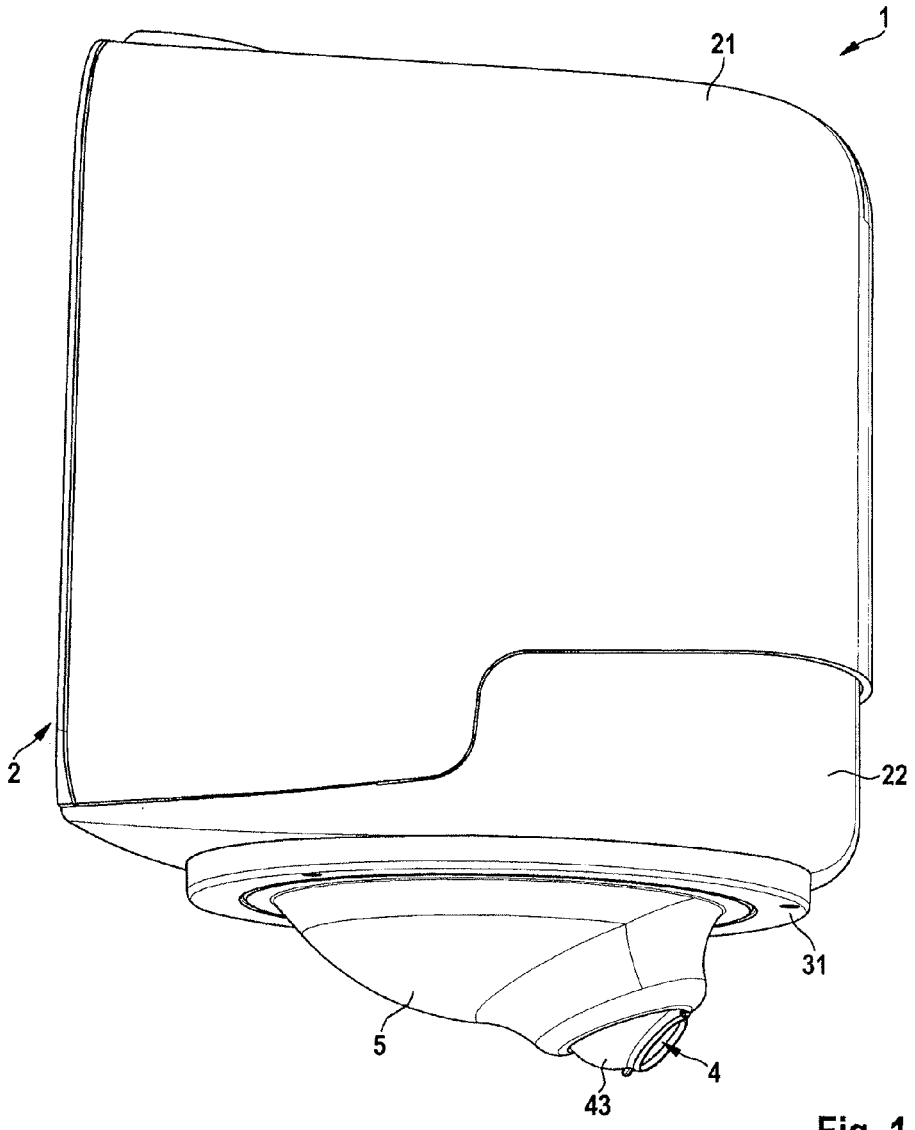
FIG. 1 is a schematic perspective view of a sheet product dispenser.
Figure 2:
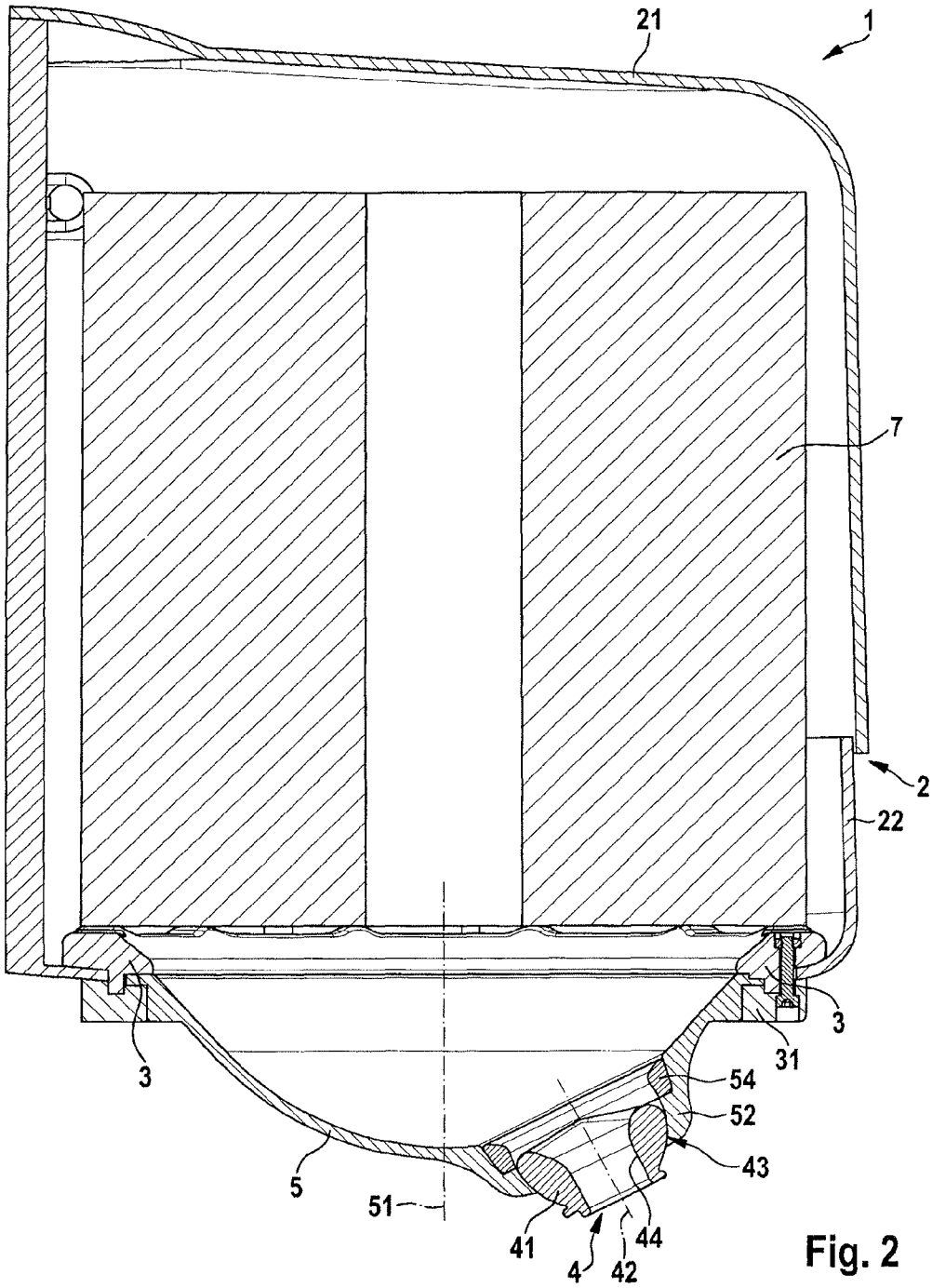
FIG. 2 is a schematic cross-sectional view of the sheet product dispenser of FIG. 1.
Figure 3:
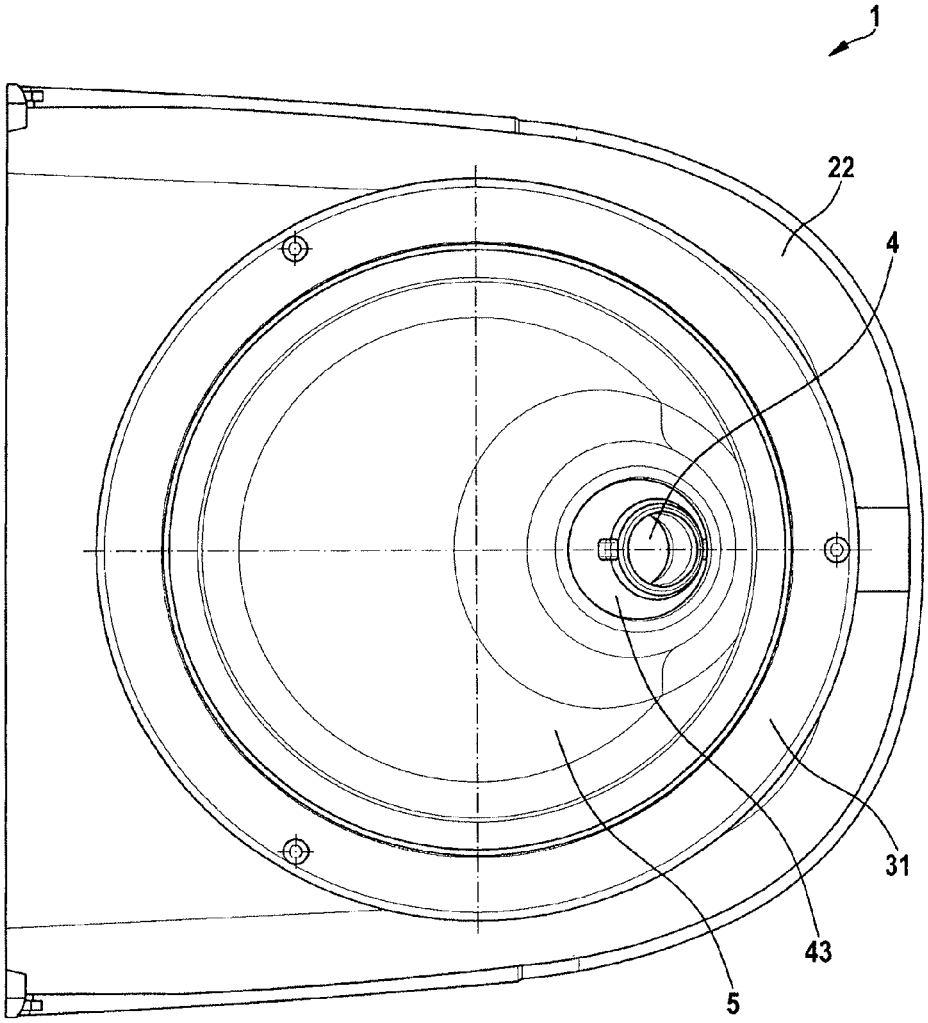
FIG. 3 is a schematic bottom view of the sheet product dispenser of FIG. 1.

FIGS. 1 to 3 illustrate a sheet product dispenser 1 that can be used for dispensing different types of sheet product. Before first usage, the dispenser 1 is typically mounted with its back surface attached to a wall of a building using any suitable attaching means such as screws.

The dispenser 1 includes a housing 2 for accommodating a source of a sheet product 7. The housing 2 may be formed of metal, plastics, or any other suitable solid material and may have various shapes. The housing 2 may include a cover 21 and a base part 22, wherein the cover 21 can be opened for loading the source of a sheet product 7 into the housing 2.

In the following, the term sheet product is used, e.g., for any type of natural and/or synthetic, absorbent or non-absorbent, woven or non-woven cloth or paper sheets such as paper towels, facial tissue, or toilet paper. The sheet product may be provided with a predetermined surface roughness and a predetermined thickness.

The source of sheet product 7 can be stored in the dispenser 1 as a pile of individual sheets or as a multiply folded sheet product strip. Such a sheet product strip may also be stored reeled up onto a roll such as a conventional roll or a centerfeed roll. The sheet product strip can be formed with or without perforation lines extending transversely to the strip direction. The perforation line will simplify detaching an individual sheet from the sheet product strip.

The dispenser 1 includes a support means 3 for supporting the source of sheet product 7 within the housing 2. Such support means 3 can, e.g., be a plate on which the source of sheet product 7 rests, wherein the plate contains an opening through which a sheet product can be detached from the support means 3 during dispensing. Alternatively, the support means 3 may be realized by a shaft on which the source of the sheet product 7 is wound. The support means 3 may be adjustable in its resistance with respect to detaching the sheet product.

The dispenser 1 further includes a dispenser opening 4 for dispensing the sheet material. When the dispenser 1 is vertically mounted on a wall, the opening 4 is located at the bottom of the housing 2. The dispenser opening 4 could also be placed at other positions. In the current figures, the dispenser opening 4 is illustrated as having a circular cross section. Alternatively, the dispenser opening 4 could have other cross sections such as ellipsoidal, rectangular, star-shaped or other.

The dispenser 1 is brought to operation by loading it with a source of sheet product 7, closing the cover 21 and positioning a leading end of the sheet product strip such that it protrudes from the dispenser opening 4, making the sheet product easily accessible to the user.

During normal operation, the sheet product can be dispensed one piece at a time by feeding the sheet product strip from the sheet product source along a dispensing path and through the dispenser opening 4 to the exterior of the housing 2 upon pulling at the leading end of the sheet product 7. A frictional force is applied on the sheet product 7 along the dispensing path such that the user needs to overcome the frictional force when pulling the sheet product strip. To detach a sheet product, the user needs to increase the pulling force such that the tensile strength of the sheet product strip, in particular the tensile strength of the perforation line, is exceeded and the sheet product is torn off. This process is configured to leave the leading end protruding from the dispenser opening 4 by a length that allows the user to have easy access.

One issue that might arise for such dispenser openings is that a frictional force applied to the sheet product during dispensing is inadequate such that the individual sheets do not break off by slightly increasing the pulling force. In this case, the sheets cannot be separated as desired by the user.

Further problems that may occur are based on the frictional force applied on the sheet product strip being too great. This may have the result that the source of the sheet product breaks early and is separated into unsuitably small pieces upon pulling or that the leading end of the sheet product remains within or retracts into the dispenser housing 2, making it difficult to be reached by the user. This issue can especially arise when the user pulls in some inclined pulling direction that strongly differs from a dispensing direction 42 of the opening 4. Said dispensing direction 42 is typically directed along a central axis of the opening 4 perpendicular to its cross section as illustrated in FIG. 2.

In view thereof, the housing 2 of the dispenser 1 further includes a rotatable dispensing member 5 in which the dispenser opening 4 is located. This rotatable member 5 can be formed as a buckled or funnel-shaped plate seated in a circular socket 31 at the bottom of the dispenser 1. It can be rotated on its rotating axis 51 as indicated in FIG. 2. The dispenser opening 4 is offset from the rotating axis 51 such that an effective lever arm is obtained. In particular, it may be provided that the rotating axis 51 does not cross the dispenser opening 4.

In case that a user now pulls the leading end of the sheet product 7 in a direction inclined from the rotating axis 51, the rotatable member 5 rotates due to a lateral force applied by the pulled sheet product strip onto the dispenser opening 4 such that the dispenser opening 4 moves as far as possible into the pulling direction. This movement minimizes the angle between the pulling direction and the dispensing direction 42 of the opening 4 and reduces a frictional force applied to the sheet product 7.

After such movement, the dispenser opening 4 will remain in its new position, offering the leading end of the sheet product strip ready for the next user to withdraw a sheet. This provides a further advantage in reducing an average distance to different positions of users. Such effect arises, e.g. in case of a dispenser 1 for paper towels positioned on a wall between two neighboring washing basins that define typical user positions in front of the basins at oblique angles from the dispenser 1.

As illustrated in FIG. 2, movement of the rotatable dispensing member 5 is restricted to a rotation around the single rotating axis 51. As a consequence thereof, the rotatable dispensing member 5 is prevented from tilting into the pulling direction, which would otherwise superpose its rotation.

This restriction of movement of the rotatable dispensing member 5 can partially be achieved by the support means 3 for supporting the sheet product 7 within the housing 2. Namely, as indicated in FIG. 2, the support means 3 is arranged to prevent the rotatable dispensing member 5 from getting pushed into the housing 2. This allows using the support means 3 for supporting the source of the sheet product 7 and to provide a stop for the rotatable dispensing member 5. Hence, the production of the dispenser 1 can be simplified and its costs can be reduced. The remaining restriction of movement out of the housing 2 is provided by the socket 31.

For further reducing the above described angle according to common pulling directions, the dispenser opening 4 may be mounted in the rotatable dispensing member 5 with its cross section in an inclined position such that a dispensing direction 42 (perpendicular to the cross section) is inclined to the rotating axis 51 of the rotatable dispensing member 5. The dispensing direction 42 is inclined toward the direction of the offset of the dispenser opening 4 from the rotating axis 51.

In this context, additional degrees of freedom for more precise adjustment of the dispensing direction 42 to the pulling direction can be achieved in that the dispenser opening 4 is formed in a mouthpiece 41. In the shown embodiment, the mouthpiece 41 provides the dispenser opening 4 in a ball joint 43 that is mounted in a partially spherical shaped socket 52 in the rotatable member 5. The ball joint 43 of the mouthpiece 41 allows the dispenser opening 4 to be pivoted about two axes perpendicular to each other. Similar functionality may be achieved by some different configuration. The dispenser opening 4 provided in the mouthpiece 41 may also be in a fixed inclined position.

When sheet products are dispensed by plural consecutive users pulling from different directions, the rotating member 5 is subject to plural rotations. Such rotations could sum up to more than 360° such that the sheet product would be twisted, inhibiting further use of the dispenser. This issue is avoided by providing the rotatable member 5 with a mechanical stop limiting the rotation to a maximum allowable value of less than 360°, in particular less than 180°. Such a stopping mechanism can, e.g., be realized by a nose-piece (not shown) attached to a peripheral part of the rotatable member 5. The nose-piece reaches to the socket 31 of the rotatable member 5 such that it is unable to pass bulges suitably positioned on the socket 31 and acting as a stop for the movement of the nose-piece. The stopping mechanism for restricting rotation of the dispensing member 5 may be provided in many different ways.

In case the rotation is restricted to a rotation range of less than 180°, a situation can be avoided in which the pulling direction oppose the current dispensing direction of the opening 4 such that no torque is applied on the rotatable member 5, and, thereby, stuck in its rotation.

Many prior art openings provide irregularly shaped dispensing paths including sharp edges which make the sheet product subject to undesirably strong frictional forces, folding, and wrinkling.

Such issues are avoided by the dispenser 1 in FIG. 2 in which the dispenser opening 4 is shaped as a mouthpiece 41. Said mouthpiece 41 has a sheet inlet and a sheet outlet each positioned concentrically on a center axis given by the dispensing direction 42, as attainable by a cone shape. The mouthpiece 41 may further form a straight guideway for the sheet product along the dispensing direction 42. One possible configuration of such a mouthpiece 41 is a cylindrical tube.

The function of the mouthpiece 42 is further assisted by a rounded lip portion 54 located close to the inlet of the mouthpiece 42 in the interior of the housing 2. This lip portion 54 supports the sheet product on its dispensing path and has a surface that is adjusted in its roughness to the sliding characteristics of the sheet product to be used. The lip portion 54 is arranged in the feeding path of the sheet product strip to limit the maximum deflection of the sheet product strip to limit the friction applied on the sheet product strip induced by deflections.

Figure 4:
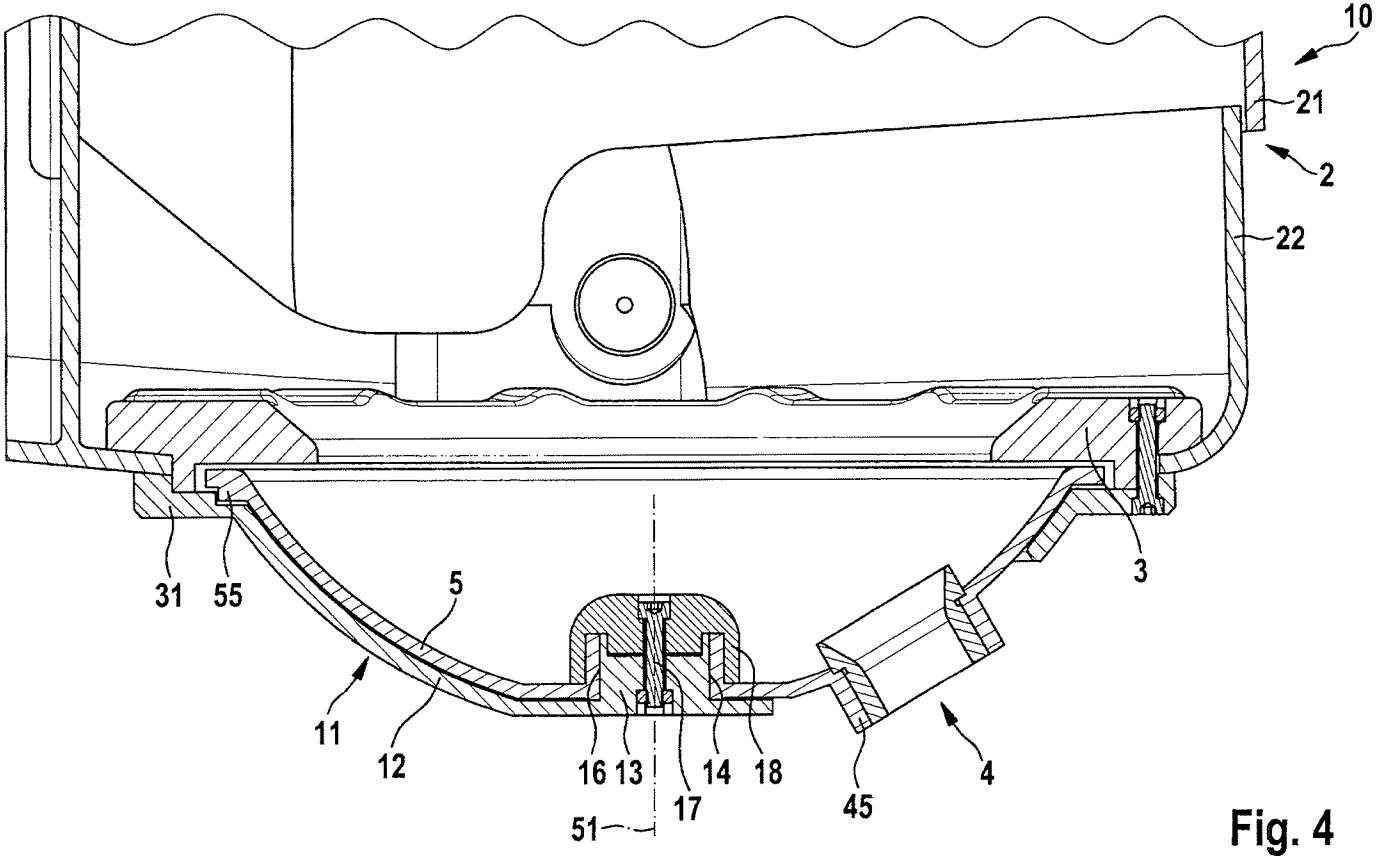
FIG. 4 is a schematic cross-sectional view of another sheet product dispenser.
Figure 5:
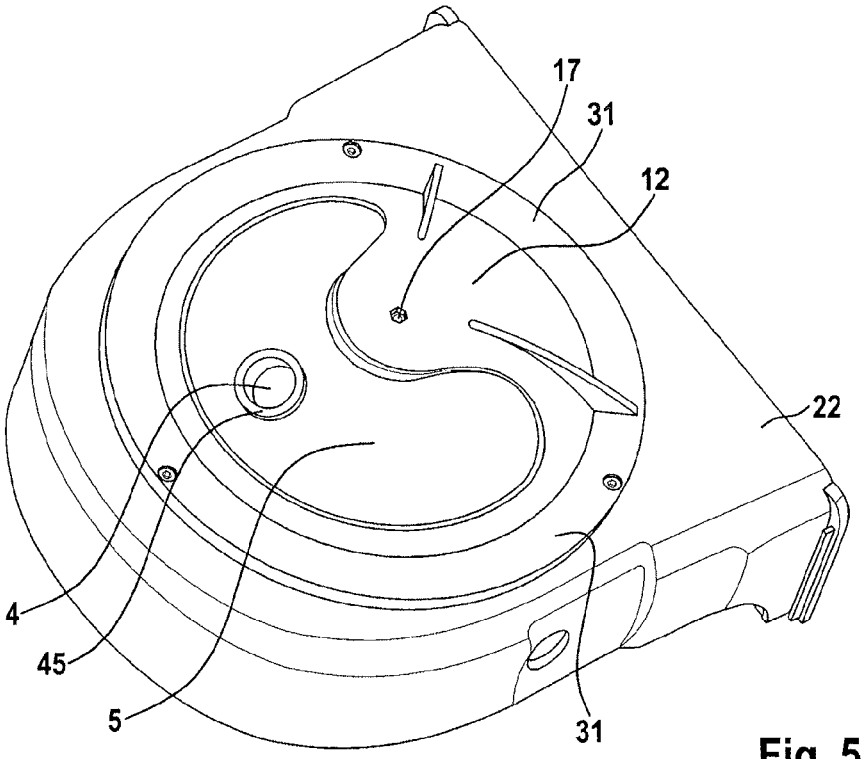
FIG. 5 is a perspective view of a base part of the sheet product dispenser of FIG. 4.

FIGS. 4 and 5 illustrate another embodiment of a dispenser 10 in a cross sectional view and in a perspective view, respectively. In difference to the embodiment in FIGS. 1 to 3, the dispensing member 5 is supported by means of a support element 11. The support element 11 is attached to or integrally formed with the socket 31 and/or the housing 2 and provides a support arm, e.g. a curved portion 12, to hold a center portion 13. The curved portion 12 substantially protrudes downwardly from the housing 2 towards the rotating axis 51 of the dispensing member 5. In certain embodiments, the curve portion 12 is of concave shape and its inner surface (surface directed to the housing) has a shape which corresponds to the curvature of the bowl-shaped (or at least partly spherically shaped) dispensing member 5 in a radial direction. The support element 11 has an extension in a circumferential direction such that the support element 11 partly encompasses the bowl-shaped dispensing member 5.

The center portion 13 is arranged on the rotating axis 51 of the dispensing member 5. The center portion 13 may be of cylindrical shape and protrudes into the direction of the housing 2 and serves to hold and to center the dispensing member 5. The center portion 13 is formed complementary to a center opening 14 in the dispensing member 5 so that the dispensing member 5 is configured to rotate around the center portion 13. The center opening 14 can be provided with a tube-shaped part 16 to accommodate the cylindrical center portion 13.

Instead of the dispensing mouthpiece 41 of embodiment of FIGS. 1 to 3 which is pivotally attached to the rotatable member 5, in the embodiment of FIGS. 4 and 5 the opening 4 of the dispensing member 5 is formed by a tube-shaped extension 45 protruding externally (away from the housing 2) from the bowl-shaped dispensing member 5. For example, the diameter of the opening 4 may be between 12 mm and 20 mm and the protruding length may be between 5 mm and 15 mm. The curved portion 12 can have a shape in a circumferential direction so that it provides a stop for the tube-shaped extension 45 of the rotatable dispensing member 5. Though the tube-shaped extension 45 is depicted as a separate element from the dispensing member 5, the tube-shaped extension 45 may be, as an alternative (not shown), integrally formed with the dispensing member 5. As a further alternative (not shown), the extension 45 of the opening 4 may be formed as another type of shape extension, for example a conical-shape extension. As another alternative (not shown), the opening 4 can be provided flush with the bowl-shaped dispensing member 5 and may protrude internally (towards the housing 2).

A circumferential edge 55 of the dispensing member 5 is loosely held between the support means 3 and the socket 31. This enables preventing the dispensing member 5 from being pushed into the housing 2, while authorizing a smooth rotation of the dispensing member 5.

Additional abutments (not shown) may be provided in order to limit the rotation of the rotatable dispensing member 5, for example by providing at least one stop to the movement of the circumferential edge 55. This enables avoiding a contact between the tube-shaped extension 45 of the rotatable dispensing member 5 and the curved portion 12, or stopping the rotation of the rotatable dispensing member 5 in case the opening 4 is provided flush with the bowl-shaped dispensing member 5.

As an option, in order to further prevent the dispensing member 5 from being pushed into the housing 2, a cap 18 can be provided which is placed on the protruding part of the center portion 13 overlapping the edges of the opening 14 of the dispensing member 5. In the present embodiment wherein the opening 14 of the dispensing member 5 is strengthened by the tube shaped part 16, the cap 18 accommodates the tube shaped part 16 and the center portion 13 such that the dispensing member 5 is attached to the support element 11 in a form fit manner. A screw 17 can be provided to connect the cap 18 with the center portion 13 such that the engagement of the dispensing member 5 and the center portion 13 is maintained and a rotation of the dispensing member 5 around the center portion 13 is allowed.

For the above rotatable dispensing member 5, a reset means can be provided, e.g. a spiral spring or the like (not depicted in the drawings), to exert a reset force onto the rotatable dispensing member 5. The spiral spring can provide a momentum onto the rotatable dispensing member 5 so that the rotatable dispensing member 5 may be rotated back to a reset position if deflected. In the case of the spiral spring, it can e.g. be provided between the center portion 13 and the tube-shaped part 16 and attached thereto in order to provide a reset tension if the rotatable dispensing member 5 has been turned when a sheet has been withdrawn.

Figure 6A:
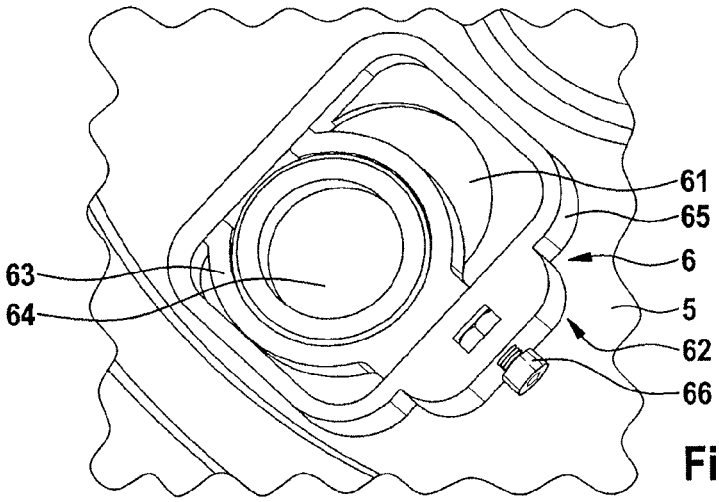
FIGS. 6*a* to 6*c* illustrate different states of a movable opening of a sheet product dispenser as an alternative of the sheet product dispenser of FIGS. 4 and 5.
Figure 6B:
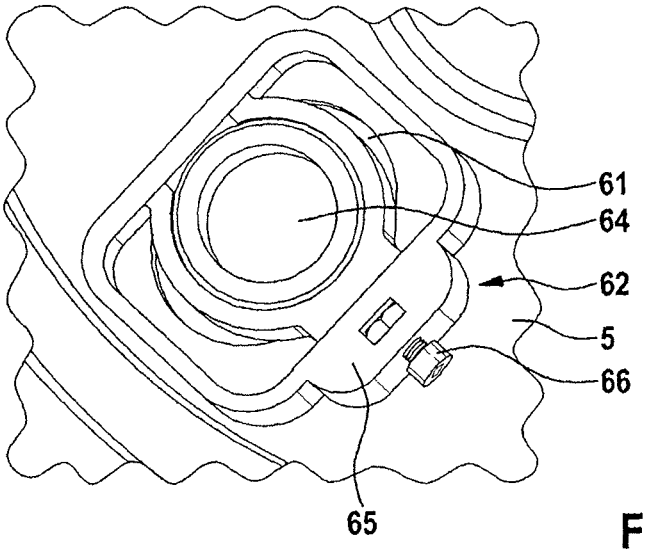
Figure 6C:
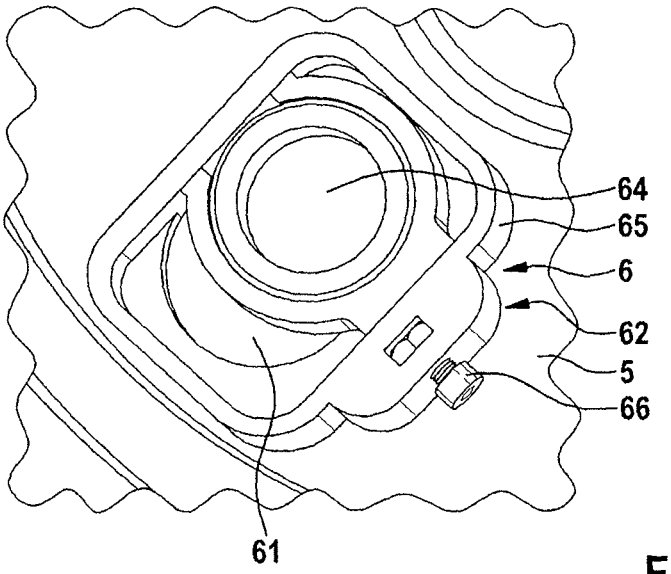

In FIGS. 6*a* to 6*c*, different states of an alternative provision of a dispensing means 6 are shown where the dispensing member 5 has a cut-out 61 with a longitudinal shape in radial direction. On the cut-out 61, for example outwardly, an adjustment element 62 is arranged that encloses the cut-out 61. The adjustment element 62 has an outer member 65 and an inner member 63 providing an inner opening 64 which is adjusted to the cut-out 61 and acts as a dispenser opening.

The inner member 63 can be moved slidably within the outer member 65 of the adjustment element 62 along the radial direction of the dispensing member 5. In order to slide the inner member 63, it can be coupled with an adjustment screw 66 which is hold in the outer member 65 so that by turning the adjustment screw 66 the inner part 63 can be moved.

The inner opening 64 may be circular in shape and can be adjusted along the cut-out 61 so that the radial distance of the inner opening 64 through which the paper will be dispensed can be adjusted according to the mechanical friction of the dispenser. In other words, the radial distance from the rotation axis 51 is adjusted so that the dispensing member 5 easily turns and adapts to the pulling direction when the strip of paper is withdrawn. FIGS. 6*a* to 6*c* illustrate different positions of the inner part 63 providing the inner opening 64 with different distances from the rotating axis 51 of the dispensing member 5.

In view thereof, the above described dispensers 1, 10 can be provided in combination with the source of the sheet product 7 as a sheet product dispensing system, in particular with the sliding characteristics of the sheet product being suitably adapted to the feeding path from the sheet product source 7 to the dispenser opening 4.

REFERENCE LIST

1 dispenser
2 housing
3 support means
4 opening
5 dispensing member
6 dispensing means
7 sheet product
8 cap
11 support element
12 curved portion
13 center portion
14 center opening
16 tube-shaped part
17 screw
18 cap
20 inner opening
21 cover
22 base part
31 circular socket
41 mouthpiece
42 dispensing direction
43 ball joint
45 tube shaped extension
51 rotating axis
52 spherical shaped socket
54 lip portion
55 circumferential edge
61 cut-out
62 adjustment element
63 inner part
64 dispensing opening
65 outer part
66 adjustment screw

The invention claimed is:

1. A sheet product dispenser comprising:

a housing for accommodating a source of a sheet product;

a rotatable dispensing member; and a dispenser opening for dispensing the sheet product, wherein rotation of the rotatable dispensing member is restricted to one rotating axis and the dispenser opening is offset from the rotating axis of the rotatable member, and wherein rotation of the rotatable dispensing member results from a lateral force applied by a pulled sheet product strip onto the dispenser opening such that the dispenser opening moves as far as possible into a pulling direction so as to minimize an angle between the pulling direction and a dispensing direction of the dispenser opening.

2. The dispenser according to claim 1, wherein the dispenser opening is arranged to supply the sheet product in a dispensing direction, and wherein a cross section of the dispenser opening perpendicular to the dispensing direction is inclined from the rotating axis.

3. The dispenser according to claim 1, further comprising a reset means to exert a reset force onto the rotatable dispensing member so that the rotatable dispensing member is rotatable towards a reset position if deflected.

4. The dispenser according to claim 1, wherein the opening is provided in a dispensing mouthpiece pivotally attached to the rotatable dispensing member such that the mouthpiece pivots about at least one axis.

5. The dispenser according to claim 4, wherein the dispensing mouthpiece comprises a ball joint mounted in a partly spherical shaped socket in the rotatable member.

6. The dispenser according to claim 4, wherein the dispensing mouthpiece has a straight guideway for the sheet product along a dispensing direction to the dispenser opening.

7. The dispenser according to claim 6, further comprising a rounded lip portion located at the rotatable dispensing member close to an inlet of the mouthpiece and adapted for sliding support of the sheet product on a dispensing path during dispensing.

8. The dispenser according to claim 4, wherein the mouthpiece pivots about two axes perpendicular to each other.

9. The dispenser according to claim 1, further comprising a mechanical stop that limits the rotation of the rotatable dispensing member to less than 360°.

10. The dispenser according to claim 9, wherein the mechanical stop limits the rotation of the rotatable dispensing member to less than 180°.

11. The dispenser according to claim 1, further comprising a support supporting the source of the sheet product within the housing and preventing displacement of the rotatable member into the housing.

12. The dispenser according to claim 1, wherein the rotatable member is mounted in a circular socket that prevents displacement of the rotatable dispensing member out of the housing.

13. The dispenser according to claim 1, further comprising a support element comprising a support arm and a center portion, wherein the support arm extends downwardly from the housing toward the rotating axis, and wherein the center portion provides a bearing to bear the rotatable dispensing member.

14. The dispenser according to claim 13, wherein the center portion protrudes in the direction toward the housing along the rotating axis, and wherein the rotatable dispensing member has a center opening through which the center portion protrudes to provide the bearing.

15. The dispenser according to claim 14, further comprising a cap attached onto the center portion to hold the rotatable dispensing member in a form fit manner.

16. The dispenser according to claim 1, wherein the dispensing member has a cut-out with a longitudinal shape in radial direction, wherein an adjustment element encloses the cut-out, and wherein the adjustment element includes an inner opening which can be moved relative to the cut-out.

17. A sheet product dispensing system comprising:

the sheet product dispenser according to claim 1; and a source of a sheet product, wherein the sheet product comprises a sheet product strip, the leading end of which is guided through the dispenser opening.

18. The dispenser according to claim 1, further comprising a spring to exert a reset force onto the rotatable dispensing member so that the rotatable dispensing member is rotatable towards a reset position if deflected.

* * * * *